US008031128B2

(12) United States Patent
Tanielian et al.

(10) Patent No.: US 8,031,128 B2
(45) Date of Patent: Oct. 4, 2011

(54) ELECTRICALLY SMALL ANTENNA

(75) Inventors: Minas H. Tanielian, Bellevue, WA (US); Robert B. Greegor, Auburn, WA (US); Claudio G. Parazzoli, Seattle, WA (US)

(73) Assignee: The Boeing Company, Chicago, IL (US)

( * ) Notice: Subject to any disclaimer, the term of this patent is extended or adjusted under 35 U.S.C. 154(b) by 698 days.

(21) Appl. No.: 12/116,556

(22) Filed: May 7, 2008

(65) Prior Publication Data

US 2009/0278754 A1 Nov. 12, 2009

(51) Int. Cl.
*H01Q 9/28* (2006.01)

(52) U.S. Cl. ..... 343/795; 343/705

(58) Field of Classification Search ..... 343/705, 343/795

See application file for complete search history.

(56) References Cited

U.S. PATENT DOCUMENTS

| | | | | |
|---|---|---|---|---|
| 2,995,752 | A * | 8/1961 | Shyhalla et al. | 342/420 |
| 3,789,416 | A | 1/1974 | Kuecken et al. | |
| 6,329,955 | B1 | 12/2001 | McLean et al. | |
| 6,437,750 | B1 * | 8/2002 | Grimes et al. | 343/726 |
| 6,473,048 | B1 | 10/2002 | Diaz | |
| 6,750,820 | B2 | 6/2004 | Killen et al. | |
| 6,847,328 | B1 | 1/2005 | Libonati et al. | |
| 6,958,729 | B1 | 10/2005 | Metz | |
| 7,218,285 | B2 | 5/2007 | Davis et al. | |
| 7,265,730 | B2 | 9/2007 | Iizuka et al. | |
| 2004/0118313 | A1 | 6/2004 | Temes et al. | |
| 2006/0028385 | A1 | 2/2006 | Davis et al. | |
| 2009/0140946 | A1 * | 6/2009 | Ziolkowski et al. | 343/788 |

OTHER PUBLICATIONS

Richard W. Ziolkowksi and Allison D. Kipple, "Reciprocity between the effects of resonant scattering and enhanced radiated power by electrically small antennas in the presence of nested metamaterial shells", Physical Review, The American Physical Society, 2005, pp. 036602-1 to 036602-5, Department of Electrical and Computer Engineering, The University of Arizona, Tucson, Arizona.

Jeffrey J. Daniels, "Ground Penetrating Radar Fundamentals", Appendix to a report to the U.S.EPA, Region V, Nov. 25, 2000, pp. 1-21, Department of Geological Sciences, The Ohio State University, Ohio.

Claudio G Parazzoli et al; "Applications of metamaterials in the GHz frequency domain", Antennas and Propagation International Symposium, 2007 IEEE, IEEE, Piscataway, NJ, USA, Jun. 1, 2007, pp. 1152-1155, XPO.

Erentok Aycan et al: "Low frequency lumped element-based negative index metamaterial", Applied Physics Letters, AIP, American Institute of Physics, Melville, NY, US, vol. 91, No. 18, Nov. 2, 2007, pp. 184101-184104, XP012100006.

Ziolkowski R W: "Metamaterial-based efficient electrically small antennas", IEEE Transactions on Antennas and Propagation Jul. 2006 Institute of Electrical and Electronics Engineers Inc., US, vol. 54, No. 7, Jul. 2006, pp. 2113-2130, XP02562388.

(Continued)

*Primary Examiner* — Tho G Phan

(74) *Attorney, Agent, or Firm* — McNees Wallace & Nurick LLC

(57) ABSTRACT

An electrically small antenna (ESA) for resolution of sub-wavelength features is disclosed. The ESA is on the order of meters and has an efficient transmit/receive capability. The ESA is 1/10 of the length of the equivalent dipole length, and may be scaled down to 1/10,000. The ESA includes a metamaterial shell. Such an antenna may include phase sensitive current injection in the metamaterial resonant structures for loss-compensation.

18 Claims, 6 Drawing Sheets

OTHER PUBLICATIONS

Ziolkowski R W: "Metamaterial-based antennas: research and developments" IEICE Transactions on Electronics, Electronics Society, Tokyo, JP, vol. E89-C, No. 9, Sep. 1, 2006, pp. 1267-1275, XP002481300.

McVay J et al: "Radiation characteristics of microstrip dipole antennas over a high-impedance metamaterial surface made of hilbert inclusions", 2003 IEE MTT-S International Microwave Symposium Digest. (IMS 2003). Philadelphia, PA, Jun. 8-13, 2003; [IEEEMTT-S International Microwave Symposium], New York, NU: IEEE, US, vol. 1, Jun. 8, 2003, pp. 587-590, XP010644663.

Alois Krischke: "Rothammels Antennenbuch" 2001, Darc Verlag GMBH, XP002562390, p. 67.

John D. Kraus: "Antennas", 1988, McGraw-Hill, XP002562389, p. 244.

* cited by examiner

ELECTRICALLY SMALL ANTENNA

BACKGROUND

The application generally relates to electrically small antennas (ESAs). The application relates more specifically to ESAs including metamaterial resonant structure to reduce antenna size. The ESA may be mounted on an aircraft for the identification and mapping of subsurface facilities or features.

One object of gathering intelligence data is the identification, mapping, and location of deeply buried underground facilities. The scientific community is interested in methods for locating and mapping underground facilities in non-accessible territory to determine, for example, whether underground nuclear facilities are situated in underground bunkers. A key factor that makes it difficult to detect, locate or map such underground facilities is that conventional radar does not penetrate the Earth's surface. When using conventional radar the electromagnetic waves are reflected and attenuated by the soil, due to the finite conductivity and dielectric loss of the soil.

Typical ground penetrating radar (GPR) may operate in the frequency range of 100-400 MHz, but in that frequency range, the radar can penetrate the Earth's surface to a depth of only about one meter. In order for radar waves to penetrate deeper into the ground, a radar signal with a lower frequency, e.g., in the range of 10-150 kHz, is required. At frequencies as low as 10-150 kHz, the electromagnetic radar wave can penetrate the Earth to a depth as great as 100 meters or more, depending on the soil characteristics. However, since radar antennas are geometrically proportional to the wavelength, operating a radar system at frequencies as low as 10-150 kHz normally requires an enormous antenna. The corresponding wavelengths of 10-150 kHz radiowaves range from 30 km to 3 km. Such an antenna cannot be carried efficiently by an airplane, and in any event may not radiate sufficient power to generate a ground-penetrating radar wave. Further, the resolution of such a low frequency radar system would have limited diffraction properties. Such a radar system would be diffraction limited and able to resolve only those objects or features of sizes comparable to the wavelength. Such relatively large objects or features are much larger than most of the features that are being sought.

These existing GPRs are based on transmitting a very short pulse which includes all of the long wavelength Fourier components and can thus penetrate the ground to some extent. However, such GPRs at best penetrate the ground within about a meter of the Earth's surface. Such GPRs are typically used to locate wires, pipes etc. under the ground within about a meter of the top surface. None of the short pulse GPRs can penetrate to a subsurface depth of about 100 meters, which is the range of depth illumination that is required for detecting strategic underground facilities.

Existing methods for identification and mapping of underground facilities include satellite imagery that can indicate construction or excavation activities on the Earth's surface. Satellite imagery provides an approximate or general location of such a facility. However, many underground facilities are accessible by a rather long tunnel that leads from the excavation point to the final underground destination point, meaning that identifying the entrance point at the surface may provide an inaccurate indication of the location of the underground facility. Depending on the length of the access tunnel, the area to be mapped underground could cover a rather large physical area, on the order of many square kilometers.

Other suggested methods to identify underground facilities require placement of acoustic sensors in the ground to detect activity associated with such underground facilities. Small sensors placed in the vicinity of such a structure may pick up acoustic signatures for identifying the exact location of the facility. However, it is not always possible to place sensors, conceal them from discovery, and then periodically interrogate such sensors in the vicinity of such an underground facility. The underground facilities of interest are often located in restricted areas, e.g., facilities located on foreign territory. Furthermore, it would be necessary to have determined, in advance, at least a general location of such an underground facility. Unless the ground sensors are placed in the exact location where detection of signals is likely, it would be easy to miss detection of the target. Finally, the logistics and cost of placing a large number of sensors make placing acoustic sensors an impractical and unattractive solution.

Electrically small antennas (ESA) are known, such as an electrically small, low "Q" radiator as disclosed in U.S. Pat. No. 6,437,750. However, these ESAs have not been configured to illuminate subterranean images.

The foregoing examples and limitations associated therewith are intended to be illustrative and not exclusive. Other limitations of the related art will become apparent to those of skill in the art upon reading of the specifications and study of the drawings. The teachings disclosed extend to those embodiments that fall within the scope of the claims, regardless of whether they accomplish one or more of the aforementioned needs.

SUMMARY OF THE INVENTION

One embodiment relates to an electrically small antenna including a dipole, a metamaterial hemispherical sphere or shell partially surrounding the dipole, and a ground plane disposed proximate the metamaterial hemispherical sphere or shell. The length of the electrically small antenna is in the range of $\lambda/10$ to $\lambda/10{,}000$ of the predetermined wavelength $\lambda$.

Another embodiment relates to an airborne antenna system including an airframe and an electrically small antenna disposed on the airframe. The electrically small antenna is in the range of $\lambda/10$ to $\lambda/10{,}000$ of the predetermined wavelength $\lambda$.

Certain advantages of the embodiments of the invention described herein include an electrically small antenna (ESA) having the capability to resolve very small objects compared to the wavelength of an interrogation signal.

Another advantage of the present invention is to provide an ESA that operates at a frequency of about 100 kHz.

Another advantage of the invention is to provide an ESA with the ability to obtain super-resolution on the order of about $\lambda/100$.

A yet further advantage of the present invention is to provide an ESA having an operating wavelength on the order of meters and which has an efficient transmit/receive capability compared to a regular dipole.

A yet further advantage of the present invention is to provide an ESA that is lighter and more efficient than a conventional dipole antenna.

Alternative exemplary embodiments relate to other features and combinations of features as may be generally recited in the claims.

BRIEF DESCRIPTION OF THE FIGURES

Wherever possible, the same reference numbers will be used throughout the drawings to refer to the same or like parts.

DETAILED DESCRIPTION OF THE EXEMPLARY EMBODIMENTS

The ESA of the current invention is on the order of meters and has an efficient transmit/receive capability compared to a regular dipole. The ESA is constructed using metamaterial concepts. The metamaterial may be single negative (SNG) (i.e. the permittivity $\epsilon<0$, or the permeability $\mu<0$) or double negative (DNG) (i.e. both the permittivity $\epsilon<0$ and the permeability $\mu<0$). In an exemplary embodiment, an ESA is disclosed that is 1/10 of the length of the equivalent dipole length, and may be scaled down to 1/1000 or 1/10,000. Such an ESA may include phase sensitive current injection in the metamaterial resonant structures for loss-compensation. In other words, the unit cells of the ESA may be driven by a current source that is in phase with the exciting electromagnetic wave. The ESA may include a magnetic or electric dipole, and the metamaterial resonant structure may be a metamaterial shell or a metamaterial hemispherical structure. In one embodiment, the ESA includes a magnetic dipole surrounded by a metamaterial hemispherical sphere. In another embodiment, the ESA includes an electric dipole surrounded by a metamaterial shell.

Figure 1:
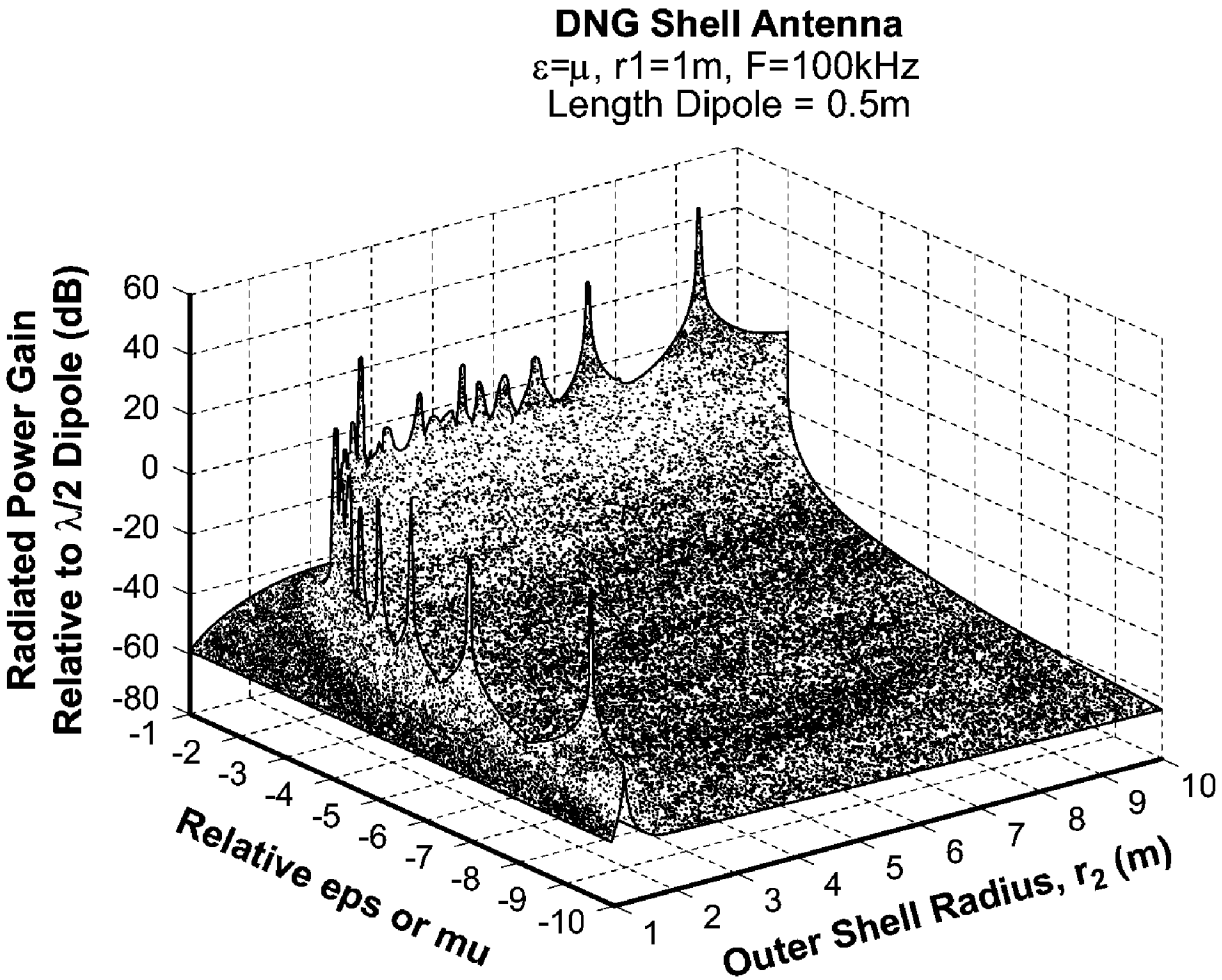
FIG. 1 is a double negative (DNG) shell antenna simulation for a 0.5 m electric dipole response to a 100 kHz signal that demonstrates an embodiment of an ESA in the frequency range of interest.
Figure 2:
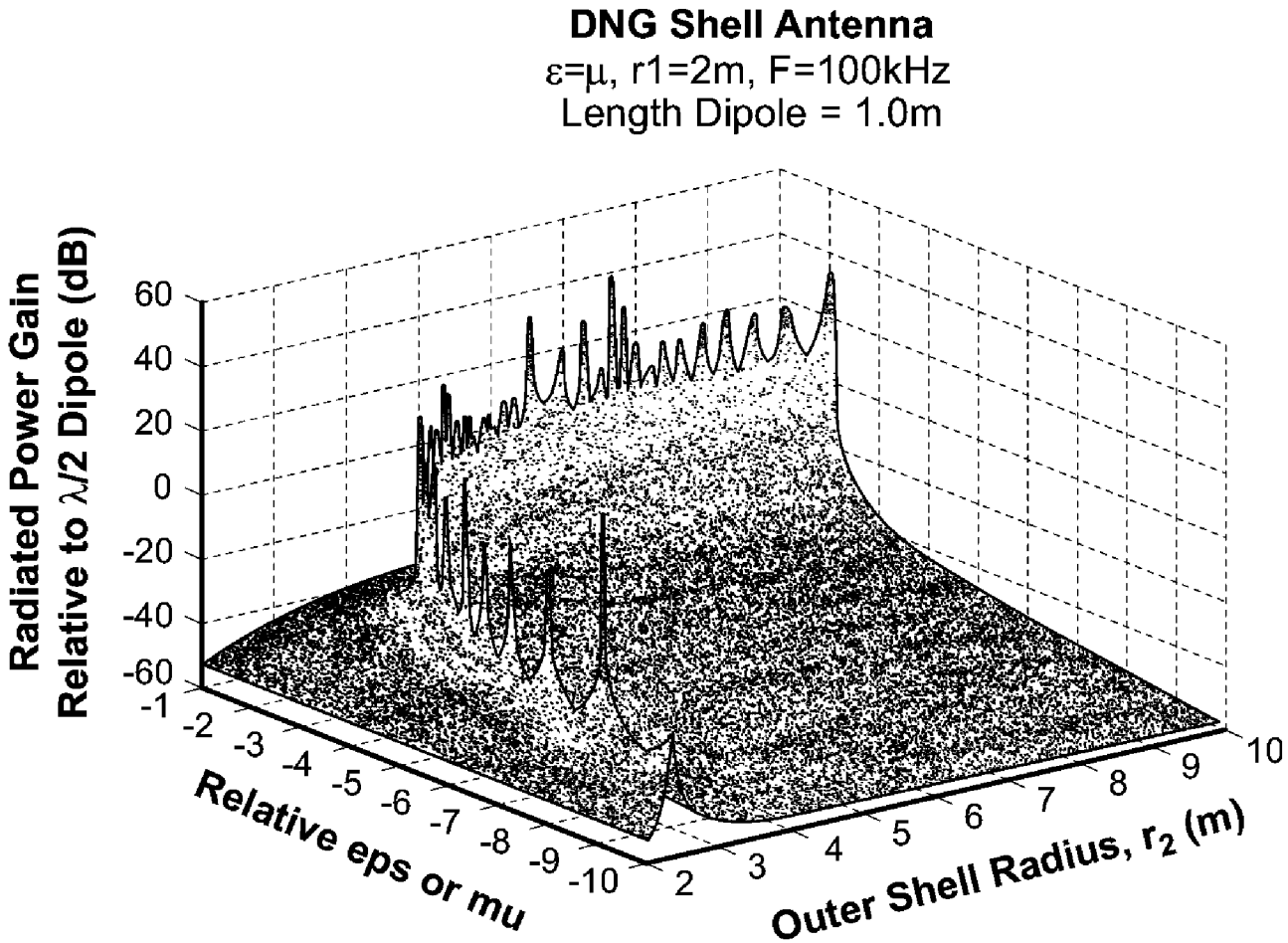
FIG. 2 is a double negative (DNG) shell antenna simulation for a 1.0 m electric dipole response to a 100 kHz signal that demonstrates an embodiment of an ESA in the frequency range of interest.
Figure 3:
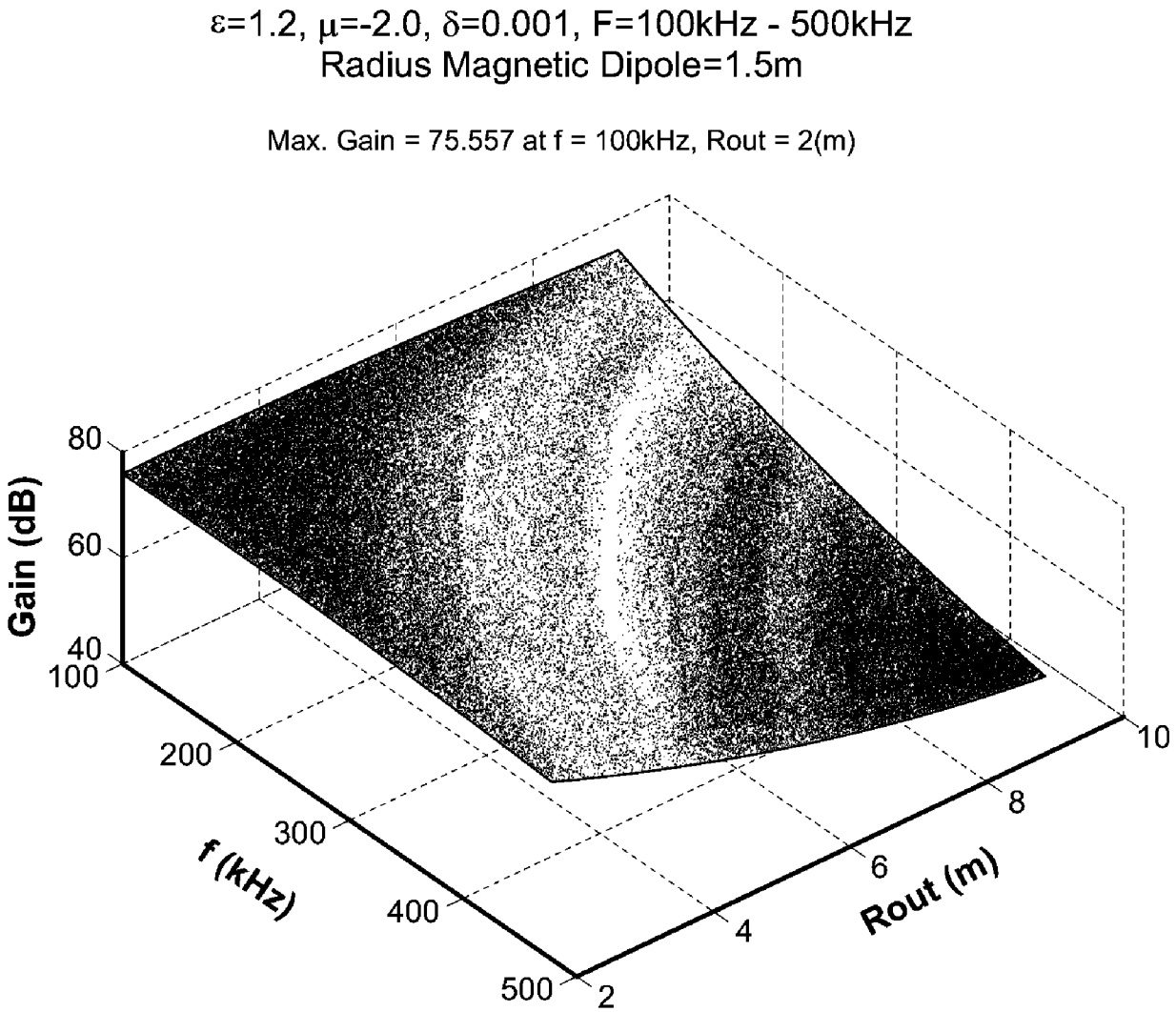
FIG. 3 is a MNG hemispherical antenna simulation for a 1.5 m magnetic dipole response over a 100 kHz to 500 kHz signal that demonstrates an embodiment of an ESA in the frequency range of interest.

FIGS. 1 and 2 show simulations for a 0.5 m and 1.0 m electric dipole, respectively, in a spherical shell constructed of double negative (DNG, both the shell permittivity $\epsilon$ and the shell permeability $\mu$ are negative) or negative index of refraction (NIM) material. For inner radii r1 and outer radii r2 on the order of a few meters this electrically small antenna (ESA) has a gain with respect to a 100 kHz, $\lambda/2$ dipole (1.5 km) antenna. This exemplary ESA is sufficient for application in mapping underground facilities, assuming proper choices of $\epsilon$ and $\mu$, which are based on, for example, properties of the physical dimensions of the antenna, the capacitance and inductance of the design, discrete elements, and construction materials. Proper choices of the shell material are those values of $\epsilon$ and $\mu$ that result in a radiated power level that is comparable to or better than the power level of a large half-wavelength dipole ($\lambda/2$). As can be appreciated from FIG. 1, for reasonable values of $\epsilon$ and $\mu$ in the −1 to −3 range, significant gains can be achieved over conventional $\lambda/2$ dipoles. FIG. 3 shows a similar simulation for a 100 kHz to 500 kHz MNG magnetic dipole shell antenna in the $\lambda/d=1000$ range. The 1.5 m magnetic dipole antenna is contained by a metamaterial sphere having $\epsilon=1.0$ and $\mu=-2.0$ of radius $R_{out}$. $R_{out}$ being the outer radius of the sphere.

Figure 4:
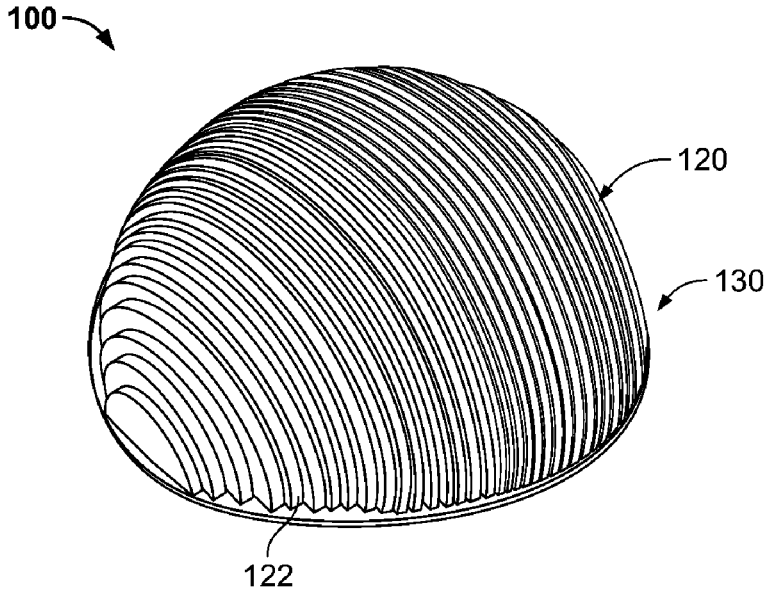
FIG. 4 is an exemplary embodiment of an electrically small antenna according to the invention.
Figure 5:
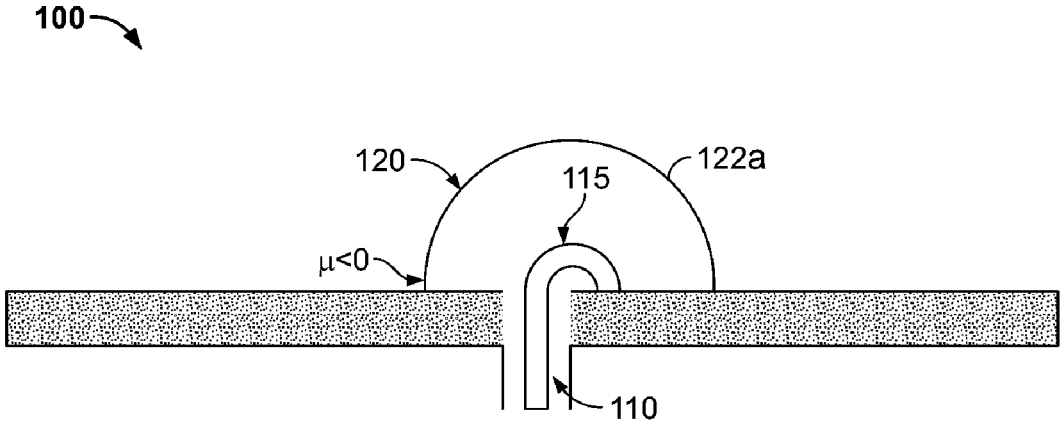
FIG. 5 is a cross sectional view of FIG. 1 taken along line A-A.

Referring to FIGS. 4 and 5, an electrically small antenna (ESA) 100 is disclosed. The ESA 100 includes a coax cable 110 terminating in a dipole 115, a hemispherical sphere 120 disposed around the dipole 115, and a ground plane 130 supporting the dipole 115 and hemispherical shell 120. The dipole 115 may be a magnetic or electric dipole. In this exemplary embodiment, the dipole 115 is a magnetic dipole. The hemispherical sphere 120 includes a plurality of stacked semicircle sheets 122. The semicircle sheets 122 having unit cells imprinted thereupon. In an operational configuration, a not-illustrated radome of a known type would typically be provided over the hemispherical sphere 120. However, for clarity and convenience, the radome is omitted from FIGS. 4 and 5. In an exemplary embodiment of the invention illustrated in FIG. 6, an airborne antenna system 300 includes and airframe 310 and an ESA (not shown) disposed within a radome 320. The airframe 310 is exemplary only, and may be any aerial platform including an airplane, a missile, satellite, or other airborne platform. In yet another exemplary embodiment, the ESA 100 may be included in a ground platform (not shown).

The ESA 100 can resolve subwavelength features. Subwavelength features are features that are smaller than the illuminating or probing wavelength. Commonly owned U.S. patent application Ser. No. 12/116,540, entitled "Identification and Mapping of Underground Facilities", filed concurrently with the present patent application, discloses an exemplary application of the ESA including a method and system for the identification and mapping of subsurface facilities, and the same is hereby incorporated by reference in its entirety.

Figure 6:
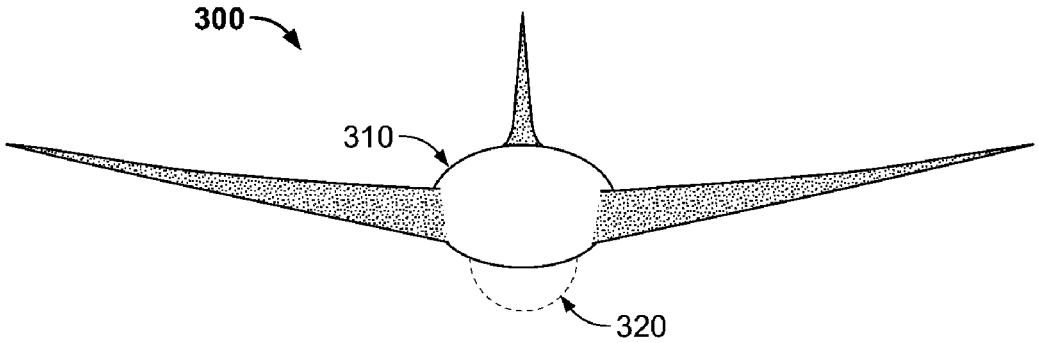
FIG. 6 is an exemplary embodiment of an aircraft including an ESA.

As can be seen in FIG. 6, which illustrates the center cross-section of the ESA 100 taken through the semicircle sheet of the greatest radius 122*a* of FIG. 5, the dipole 115 is disposed within the semicircle sheet of the greatest radius 122*a* so as to dispose the dipole 115 in the equatorial plane of the hemispherical sphere 120. The dipole 115 is formed from the coax conductor having the insulation removed.

Figure 7:
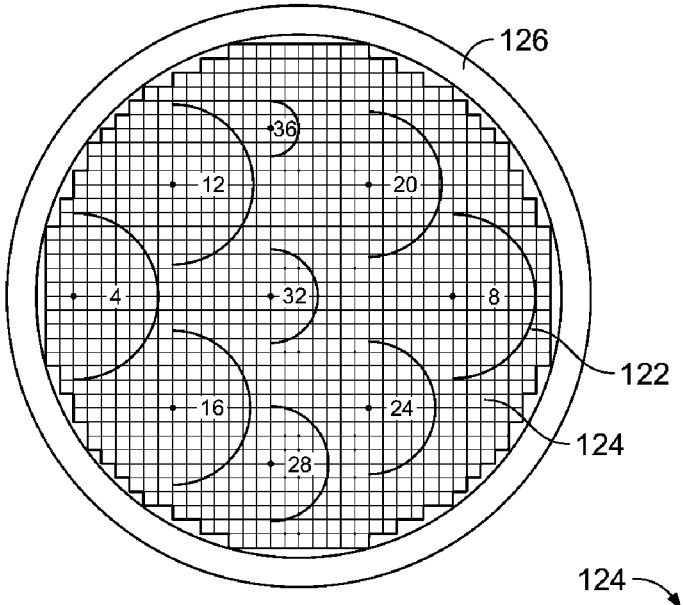
FIG. 7 is an exemplary embodiment of a patterned substrate.

The hemispherical sphere 120 is formed by stacking semicircle sheets 122 of differing radii. The semicircle sheets 122 are formed by disposing an array of unit cells 124 on the substrate 126 to form a patterned substrate as shown in FIG. 7, and sectioning the patterned substrate into semicircle sheets 122 of varying radii.

Figure 8:
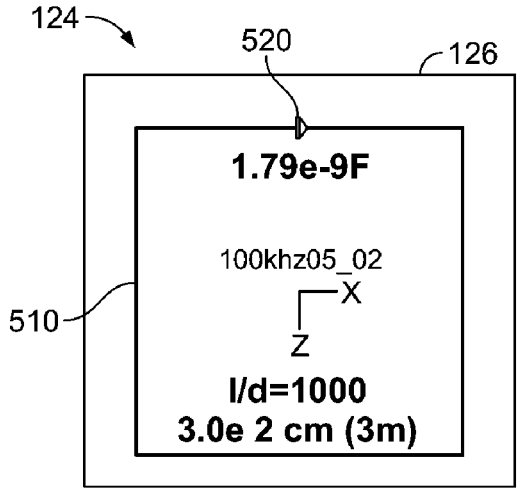
FIG. 8 is an exemplary embodiment of a MNG unit cell.

An exemplary embodiment of a unit cell 124 configured to operate at 100 kHz with a $\lambda/d=1000$ is shown in FIG. 8. As can be seen in FIG. 8, the unit cell 124 includes a conductive path 510 disposed on a substrate 126 and a capacitor 520 disposed in the conductive path 510. The conductive path 510 may be a conductive wire or trace formed of a conductive material. The conductive material and capacitance of the capacitor can be selected to resonate the loop of the individual unit cells 124 at a desired frequency. The configuration of the unit cells 124 may vary as would be appreciated by one of ordinary skill in the art.

Figure 8A:
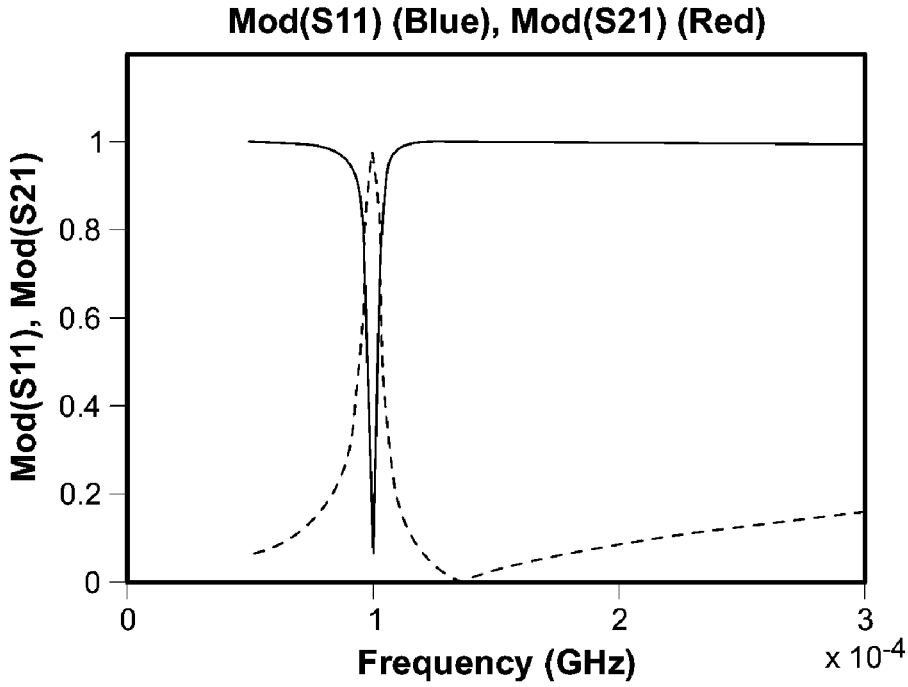
FIG. 8A is a graphical illustration of scattering parameters of the exemplary unit cell of FIG. 8 for a 100 kHz application.
Figure 8B:
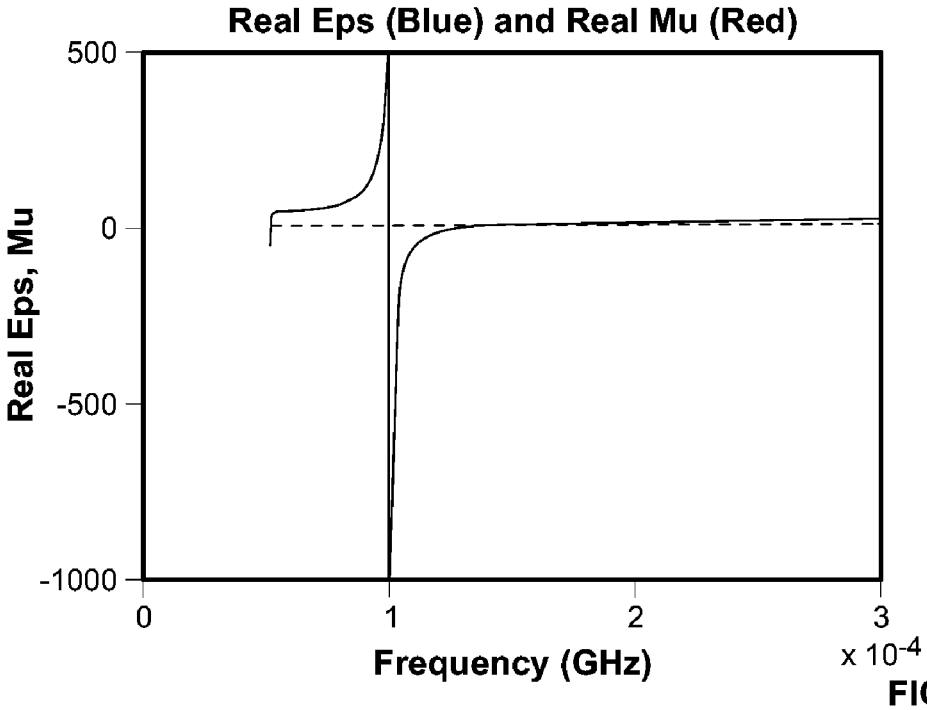
FIG. 8B is a graphical illustration of permeability of the exemplary unit cell of FIG. 8 showing the necessary range of permeability and resonance for a 100 kHz application.

In this exemplary embodiment, the conductive path 510 is formed of a copper wire. In other embodiments, the conductive path 510 may be formed of any conductive material. The substrate 126 is formed of a dielectric material. In one embodiment, the substrate 126 is formed of alumina, however, the substrate 126 may be formed of any dielectric material as would be appreciated by one of ordinary skill in the art. For example, the dielectric material may be Rexolite®, a cross linked polystyrene microwave plastic made by C-Lec Plastics, or Rogers 5880, a glass microfiber reinforced PTFE composite made by Rogers Corporation. In this exemplary embodiment, the capacitor 520 is a 1.79 nF lumped element capacitor. In other embodiments, the capacitor 520 may be chosen in accordance with the inductance of the loop of the unit cell 124 to provide a desired resonant frequency. FIGS. 8A and 8B show the scattering S-parameter, permittivity and permeability of the unit cell 124 of this exemplary embodiment operating at a 100 kHz with a $\lambda/d=1000$.

It should be understood that the application is not limited to the details or methodology set forth in the following description or illustrated in the figures. It should also be understood that the phraseology and terminology employed herein is for the purpose of description only and should not be regarded as limiting.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrically small antenna, comprising:

a dipole;

a metamaterial hemispherical sphere or shell partially surrounding the dipole; and a ground plane disposed proximate the metamaterial hemispherical sphere or shell;

wherein the length of the electrically small antenna is in the range of $\lambda/10$ to $\lambda/10{,}000$ of the predetermined wavelength $\lambda$; and wherein the metamaterial hemispherical sphere or shell comprises semicircle sheets, the semicircle sheets comprising a plurality of unit cells.

2. The electrically small antenna of claim 1, wherein the electrically small antenna is configured to operate in a range of about 10 kHz to about 500 kHz.

3. The electrically small antenna of claim 1, wherein the electrically small antenna is configured to operate in a range of about 10 kHz to about 150 kHz.

4. The electrically small antenna of claim 1, wherein the electrically small antenna is configured to operate at about 100 kHz.

5. The electrically small antenna of claim 1, wherein the unit cells resonate between about 10 kHz and 150 kHz.

6. The electrically small antenna of claim 1, wherein the unit cells resonate at about 100 kHz.

7. The electrically small antenna of claim 1, wherein the unit cells comprise a capacitor.

8. The electrically small antenna of claim 7, wherein the capacitor is a discrete 1.79 nF lumped element capacitor.

9. The electrically small antenna of claim 1, wherein the dipole is an electric dipole.

10. The electrically small antenna of claim 1, wherein the dipole is a magnetic dipole.

11. An airborne antenna system comprising:

an airframe; and an electrically small antenna disposed on the airframe;

wherein the electrically small antenna is in the range of $\lambda/10$ to $\lambda/10{,}000$ of the predetermined wavelength $\lambda$; and wherein the electrically small antenna comprises a metamaterial hemispherical sphere or shell disposed around a dipole, and the metamaterial hemispherical sphere or shell comprises semicircle sheets, the semicircle sheets comprising a plurality of unit cells.

12. The system of claim 11, wherein the electrically small antenna is configured to operate in a range of about 10 kHz to about 500 kHz.

13. The system of claim 11, wherein the electrically small antenna is configured to operate in a range of about 10 kHz to about 150 kHz.

14. The system of claim 11, wherein the electrically small antenna is configured to operate at about 100 kHz.

15. The system of claim 11, wherein the unit cells resonate between about 10 kHz and 150 kHz.

16. The system of claim 11, wherein the unit cells resonate at about 100 kHz.

17. The system of claim 11, wherein the unit cells comprise a capacitor.

18. The system of claim 17, wherein the capacitor is a discrete 1.79 nF lumped element capacitor.

* * * * *